United States Patent [19]

Pfingston

[11] Patent Number: 4,481,277

[45] Date of Patent: Nov. 6, 1984

[54] PHOTOGRAPHIC PRODUCTS AND PROCESSES WITH SCAVENGERS FOR SILVER IONS OR SILVER COMPLEXES

[75] Inventor: William J. Pfingston, Canton, Mass.

[73] Assignee: Polaroid Corporation, Cambridge, Mass.

[21] Appl. No.: 463,075

[22] Filed: Feb. 2, 1983

[51] Int. Cl.[3] ..... G03C 5/54; G03C 1/40; G03C 1/10

[52] U.S. Cl. ..... 430/218; 430/214; 430/219; 430/222; 430/236; 430/239; 430/505

[58] Field of Search ..... 430/214, 216, 218, 219, 430/222, 505, 239, 236, 212

[56] References Cited

U.S. PATENT DOCUMENTS

| | | | |
|---|---|---|---|
| 3,260,597 | 7/1966 | Weyerts et al. | 430/218 |
| 3,443,941 | 5/1969 | Rogers | 430/222 |
| 3,577,236 | 5/1971 | Fix | 430/218 |
| 3,719,489 | 3/1973 | Cieciuch et al. | 430/222 |
| 4,009,029 | 2/1977 | Hammond et al. | 430/219 |
| 4,060,417 | 11/1977 | Cieciuch et al. | 430/214 |
| 4,269,924 | 5/1981 | Janssens et al. | 430/214 |
| 4,314,020 | 2/1982 | Reed et al. | 430/214 |
| 4,390,613 | 6/1983 | Mehta et al. | 430/219 |

*Primary Examiner*—Richard L. Schilling
*Attorney, Agent, or Firm*—Sybil A. Campbell

[57] ABSTRACT

This invention is concerned with producing color images of improved quality in photographic processes employing silver ion assisted cleavage reactions to provide a dye image by scavenging, i.e., rendering inert substantially all of the silver ion and/or soluble silver complex in the photographic system when image formation is substantially complete.

30 Claims, 1 Drawing Figure

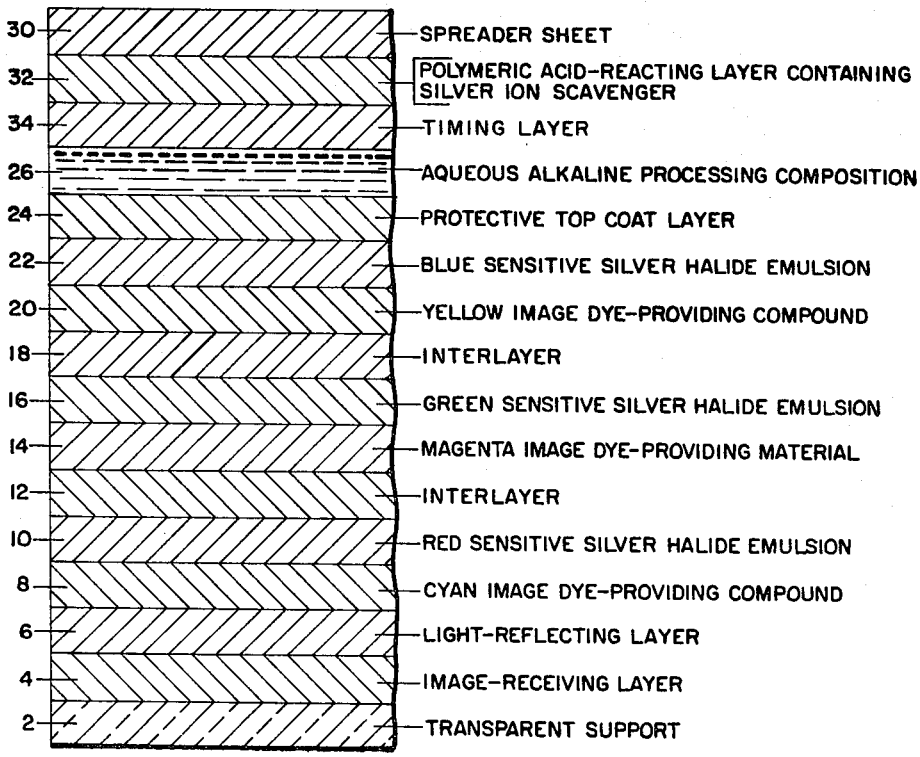

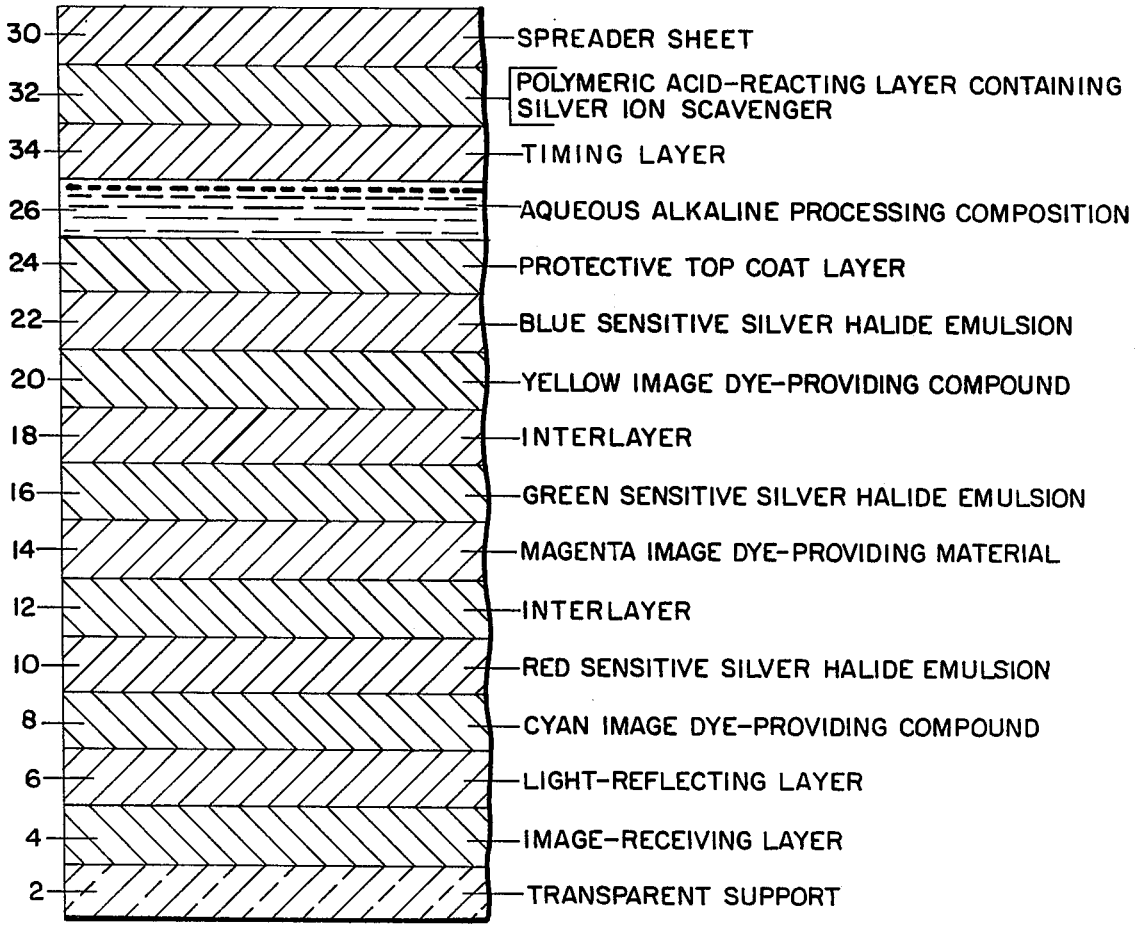
30
SPREADER SHEET
32
POLYMERIC ACID-REACTING LAYER CONTAINING SILVER ION SCAVENGER
34
TIMING LAYER
26
AQUEOUS ALKALINE PROCESSING COMPOSITION
24
PROTECTIVE TOP COAT LAYER
22
BLUE SENSITIVE SILVER HALIDE EMULSION
20
YELLOW IMAGE DYE-PROVIDING COMPOUND
18
INTERLAYER
16
GREEN SENSITIVE SILVER HALIDE EMULSION
14
MAGENTA IMAGE DYE-PROVIDING MATERIAL
12
INTERLAYER
10
RED SENSITIVE SILVER HALIDE EMULSION
8
CYAN IMAGE DYE-PROVIDING COMPOUND
6
LIGHT-REFLECTING LAYER
4
IMAGE-RECEIVING LAYER
2
TRANSPARENT SUPPORT

PHOTOGRAPHIC PRODUCTS AND PROCESSES WITH SCAVENGERS FOR SILVER IONS OR SILVER COMPLEXES

BACKGROUND OF THE INVENTION

1. Field of the Invention

This invention relates to photography, and more particularly, it relates to an improvement in multicolor photographic images prepared by processes which utilize, as the image dye-providing material, a compound capable of undergoing cleavage in the presence of an imagewise distribution or silver ion and/or soluble silver complex to liberate a corresponding imagewise distribution of color-providing moiety, e.g., a dye.

2. Description of the Prior Art

U.S. Pat. No. 3,719,489 describes and claims photographic processes employing initially photographically inert compounds which are capable of undergoing cleavage in the presence of the imagewise distribution of silver ions made available during processing of a silver halide emulsion to liberate a reagent, such as, a photographically active reagent or a dye in an imagewise distribution corresponding to that of said silver ions. In one embodiment disclosed therein, color images are produced by using as the photographically inert compounds, color-providing compounds which are substantially non-diffusible in the photographic processing composition but capable of undergoing cleavage in the presence of the imagewise distribution of silver ions and/or soluble silver complex made available in the undeveloped and partially developed areas of a silver halide emulsion as a function of development to liberate a more mobile and diffusible color-providing moiety in an imagewise distribution corresponding to the imagewise distribution of said ions and/or said complex. The subsequent formation of a color image is the result of the differential in diffusibility between the parent compound and liberated color-providing moiety whereby the imagewise distribution of the more diffusible color-providing moiety released in the undeveloped and partially developed areas is free to transfer and form a color image, e.g., in a superposed image-receiving layer.

Compounds disclosed as useful in liberating a reagent in the presence of said silver ions and/or silver complex are sulfur-nitrogen compounds containing the group —S—X—N— or —S—X—N= wherein X is

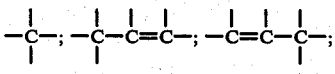

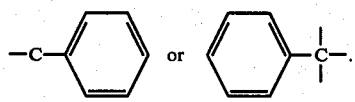

These 1,3-sulfur-nitrogen compounds may be linear or cyclic in structure, and in a particularly preferred embodiment are cyclic in structure, for example, thiazolidine compounds which comprise a dye radical having the chromophoric system of an azo, anthraquinone, phthalocyanine or other dye and a thiazolidin-2'-yl moiety which may be bonded directly to the dye radical or through an appropriate linking group.

U.S. Pat. No. 4,060,714 also is concerned with the preparation of multicolor photographic images utilizing the above-denoted color-providing compounds and discloses the use of a silver ion scavenger layer between adjacent silver halide layers to enhance color separation. Materials disclosed as useful as the non-diffusible silver halide scavengers include silver complexing agents and compounds that generate silver complexing agents which form stable complexes with silver ion and silver precipitating agents that reduce silver ion to metallic silver.

The present invention is concerned with an improvement in photographic processes of the aforementioned type which employ compounds capable of undergoing silver ion cleavage in an imagewise fashion to provide a corresponding imagewise distribution of a color-providing moiety.

SUMMARY OF THE INVENTION

According to the present invention, it has been found that color images of improved quality can be obtained in photographic processes employing silver ion assisted cleavage reactions for producing a dye image, and particularly, such processes wherein the image-carrying layer is not separated from the other layers of the film unit subsequent to processing. In particular, it has been found that color images having whiter highlights can be obtained in photographic processes of this type by scavenging substantially all of the silver ion and/or soluble silver complex in the photographic system when image formation is substantially complete. By rendering the silver ion ineffective for initiating any further cleavage of the image dye-providing material, post-processing build-up of unwanted dye, particularly in the $D_{min}$ areas of the image is substantially eliminated. Besides improved highlights, multicolor images can be obtained which exhibit improved color isolation.

It is therefore, the primary object of the present invention to provide photographic processes and photographic products useful therein for producing color images of improved quality.

Other objects of the present invention will in part be obvious and will in part appear hereinafter.

The invention accordingly comprises the several steps and the relation and order of one or more such steps with respect to each of the others, and the product possessing the features, properties and the relation of elements, which are examplified in the following detailed disclosure, and the scope of the application which will be indicated in the claims.

For a fuller understanding of the nature and objects of the invention, reference should be had to the following detailed description taken in conjunction with the accompanying drawing.

BRIEF DESCRIPTION OF THE DRAWING

The FIGURE is an enlarged diagrammatic, fragmentary sectional view of one product contemplated by the present invention.

DESCRIPTION OF THE PREFERRED EMBODIMENTS

As mentioned previously, the present invention is concerned with improving the quality of the images produced in photographic processes and products which employ an imagewise distribution of silver ion and/or soluble silver complex formed as a function of development to provide a corresponding imagewise distribution of a dye or dye intermediate from an image dye-providing material. This improvement is achieved by utilizing a silver ion scavenger to capture the silver ion and/or soluble silver complex in the photographic system when color image formation is substantially complete. The silver ion scavenger may be any material that is capable of rendering residual $Ag^+$ inert as by reduction to $Ag^\circ$ or by formation of a stable complex provided, of course, that the material selected is so constituted and/or so positioned in the photographic film unit that it is made available at a predetermined time after processing, viz., when formation of the dye image is substantially complete. This delayed availability of silver ion scavenger may be achieved in a number of ways known in the art, for example, by positioning the scavenger behind a barrier layer that will permit diffusion into the photographic system after the desired processing interval, by placing the scavenger in a layer remote from the emulsion layers so that its availability is a result of the distance through which is must diffuse, by rendering the scavenger diffusible at a certain rate using appropriate substituent groups, by encapsulating the scavenger in discrete polymeric capsules that dissolve or become permeable to diffusion of the scavenger into the photographic system at the desired time, or by incorporating the scavenger in a physical form, e.g., as a dispersion that allows it to solubilize at a certain rate. Also, the scavenger may be released from a precursor including a stable, non-diffusible precursor or a blocked precursor after a predetermined time, for example, via hydrolysis or other reaction upon contact with an aqueous alkaline solution as disclosed in U.S. Pat. Nos. 3,698,898, 3,265,498 and 4,009,029.

Materials useful as the silver ion scavenger include silver complexing agents which form stable complexes with silver ion and/or ligand exchange with soluble silver complex, compounds that generate silver complexing agents that form said stable complexes and reducing agents that reduce silver ion to metallic silver. It will be appreciated that the silver scavenger selected should be effective at the particular pH which prevails at the time said stable complex is formed or the time said silver ion is reduced. For example, the scavenging action may take place at the same pH at which the image dye-providing material undergoes silver ion assisted cleavage to form a corresponding imagewise distribution of color-providing moiety, or the scavenging action may take place at a lower pH than the pH at which said cleavage reaction occurs. Preferably, the scavenging action is effected at a pH lower than the pH at which said cleavage reaction is effected, which may be achieved in a known manner, e.g., by including an acid-reacting layer in the film structure. Where the scavenging action is effected at the same pH as said cleavage reaction, the pH preferably is reduced subsequent to image formation, e.g., by applying an acid solution. Besides enhancing the stability of the dye image, such a pH reduction insolubilizes the silver complex formed by the silver scavenger. Also, depending upon the particular photographic system, it may be desirable that the stable silver complex formed by the scavenger be substantially colorless.

Materials that may be employed for forming stable complexes with silver ion and/or soluble silver complex may be selected from various classes of compounds including azabenzimidazoles, nitroindazoles, thiazoles, hydroxy- and aminopyrimidines, tetrazaindenes, pyrazoles, triazoles, tetrazoles and particularly, mercapto compounds, such as, mercaptothiazoles, mercaptotetrazoles and mercaptopyrimidines. Also included are precursors of the aforementioned silver complexing agents such as those disclosed in aforementioned U.S. Pat. Nos. 3,698,898, 3,265,498 and 4,009,029. Materials that may be employed for reducing silver ion to metallic silver may be selected from the various classes of silver halide developing agents known in the art including developing agent precursors, such as, developing agents substituted with a hydrolyzable tail or blocked developing agents, e.g., hydroquinones and substituted hydroquinones wherein the hydroxy groups are blocked with an acyl group. Where the scavenging action is effected at a pH lower than the pH at which cleavage of the image dye-providing material occurs, reductone developing agents have been found particularly useful, such as, those forming the subject matter of copending U.S. patent application Ser. No. 221,291 of J. R. Bartels-Keith and E. R. Karger filed Dec. 30, 1980, now U.S. Pat. No. 4,371,603 issued Feb. 1, 1983.

It will be appreciated that the silver halide complexing agent or silver halide developing agent will be used in at least the amount necessary to capture i.e., render inert, the silver ion and/or soluble silver complex present in the photographic system after image formation, which amount will vary according to the particular silver ion scavenger selected and with the particular photographic system. The amount required may be readily determined empirically and generally, an excess is used to ensure that substantially all of the silver ion and/or soluble silver complex is scavenged.

In forming color images according to one embodiment of the present invention, a substantially non-diffusible image dye-providing material is present, for example, in a layer associated with each of at least two selectively sensitive silver halide emulsion layers. The emulsion layers, after being exposed, are processed simultaneously and without separation by application of an aqueous alkaline processing composition including a silver halide developing agent and a silver halide solvent. The imagewise distribution of silver ions such as contained in the soluble silver complex made available during processing of each emulsion layer migrates to the image dye-providing material associated with the emulsion and the image dye-providing material undergoes cleavage in the presence of said complex to provide an imagewise distribution of a color-providing moiety, for example, a diffusible dye which transfers, by imbibition, to an image-receiving layer, i.e., a dyeable stratum. After a predetermined time sufficient to permit formation of the transfer image, substantially all of the silver ion and/or soluble silver complex is converted to a stable silver complex or reduced to metallic silver by a silver ion scavenger initially present in one of the aforementioned layers or in a separate layer.

To be useful in the present invention, the image dye-providing compound should be photographically inert and stable in the processing composition in the absence of silver ion at least during the processing interval, but should be capable of undergoing cleavage in the presence of the imagewise distribution of silver ions and/or soluble silver complex made available as a function of development to release the color-providing moiety. Its rate of cleavage should be such that an imagewise distribution of color-providing moiety is obtained that corresponds to the imagewise distribution of silver ions and/or soluble silver complex formed in the partially exposed and unexposed areas of the emulsion. Typical of the image dye-providing compounds that may be used in the present invention are the color-providing compounds disclosed in aforementioned U.S. Pat. No. 3,719,489. Of the various classes of compounds disclosed therein, the above-denoted 1,3-sulfur-nitrogen compounds including both the linear and cyclic 1,3-sulfur-nitrogen compounds containing the group —S—X—N= or —S—X—N= are particularly useful in providing color images via silver ion assisted cleavage reactions. Particularly preferred are the cyclic compounds where both the S and N atoms are included in the ring and especially the cyclic compounds illustrated in the following formula

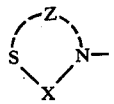

wherein Z represents the atoms, preferably carbon atoms, necessary to complete a ring-system containing at least 4 members and usually up to 20 members and X is

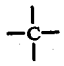

i.e. a carbon atom possessing 4 single covalent bonds in tetrahedral fashion. Examples of such compounds include thiazolidines, 1,2-tetrahydrothiazines and benzothiazolines. When employing these compounds, the color-providing moiety together with any linking group usually is substituted on said tetrahedral carbon atom and may be liberated as an aldehyde or ketone.

It will be appreciated that the respective mobility characteristics of the parent image dye-providing compound and of the liberated color-providing moiety may be substantially the same, or they may be different as appropriate for a given photographic process. The respective mobility characteristics of the parent compound and of the fragment ultimately released therefrom as the color-providing moiety may be adjusted in a known manner by appropriate substitution with an immobilizing group(s) e.g., a long chain alkyl group to render the parent and/or fragment substantially non-diffusible or by substitution with a solubilizing group, e.g., hydroxy, carboxy, or sulfo groups. Depending upon the particular parent compound, it may be advantageous to employ a combination of immobilizing and solubilizing groups to render the compound non-diffusible yet more wettable in the processing composition. Where it is desired to release a diffusible color-providing moiety from a substantially non-diffusible parent compound anchored with a single immobilizing group, the anchor should be positioned on the parent compound such that upon cleavage, it will be on a fragment different from the fragment released as the diffusible color-providing moiety. Also, it may be preferable to position the immobilizing group on that portion of the parent compound that ultimately forms a complex with the silver ion upon cleavage.

The color-providing moiety released for forming the color image may be a complete dye or a dye intermediate capable of yielding a complete dye upon subsequent reaction, for example, upon reaction with a suitable coupler to form a complete dye. The coupling reaction may take place directly in the emulsion layer or an adjacent layer to provide either a diffusible or non-diffusible dye, or it may take place in an image-receiving layer.

Complete dyes which may be used as the color-providing moiety may comprise any of the general classes of dyes heretofore known in the art, including azo, nitro, indophenol, indoaniline, anthraquinone, azomethine, phthalocyanine dyes, metal complexed or metal complexable dyes, also indicator, leuco and "temporarily color shifted" dyes. Dye intermediates include any molecule which when released is capable of forming a dye upon reaction with another molecule. For example, an imagewise distribution of a dye intermediate may be released from an image dye-providing compound, which imagewise distribution of dye intermediate reacts with another molecule to produce a corresponding imagewise distribution of complete dye. Illustrative of such photographic processes are those disclosed in U.S. Pat. No. 3,719,488 wherein an imagewise distribution of a complete dye is produced by the reaction of an aldehyde or ketone dye intermediate and a color-forming reagent, such as, a methylene coupler.

The image dye-providing compound may be present initially in the photosensitive element in a layer or layers other than the layer containing the light-sensitive silver halide emulsion. For example, it may be in a layer on one side of the emulsion or in two layers, one on either side of the emulsion. It may be present in the photosensitive layer itself if the compound is inert, that is photographically inocuous in that it does not adversely affect or impair image formation to any unacceptable extent. If not photographically inocuous, the compound may be modified in a manner which does not interfere with the development process in any way, but which deactivates the compound so that it does not affect adversely the light-sensitive emulsion. If desired, it may be separated from the silver halide emulsion layer by one or more spacer layers, or it may be contained in a layer associated with an image-receiving layer depending upon the requirements of a particular photographic system.

As noted above, the imagewise distribution of color-providing moiety may be non-diffusible from the photosensitive element so that the dye image remains therein, or the imagewise distribution of color-providing moiety may be diffusible and transferred to a single common image-receiving layer. In the latter embodiment, the photosensitive layers and the image-receiving layer may be in separate elements which are brought together during processing and thereafter retained together as the final print, or the photosensitive and image-receiving layers may be in the same element. For example, the image-receiving layer may be coated on a support and the photosensitive layers coated on the surface of the image receiving layer. The processing composition may be applied to the combined negative-postitive element using a spreader sheet to facilitate spreading the liquid composition in a uniform layer adjacent the surface of the outermost photosensitive layer. The image-receiving layer carrying the color image may be viewed as a reflection print by employing a light-reflecting layer between the photosensitive and image-receiving layers.

Illustrative of still other film units are those where the negative and positive components together comprise a unitary structure and are laminated and/or otherwise physically retained together both prior to and subsequent to transfer image formation. Generally, such film units comprise a plurality of layers including a negative component comprising at least two selectively sensitive silver halide emulsion layers and a positive component comprising an image-receiving layer. In addition to the aforementioned layers, such film units include means for providing a reflecting layer between the image receiving and negative components in order to mask effectively the silver images formed as a function of development of the silver halide emulsion layers and also to provide a background for viewing the transfer image in the receiving component, without separation, by reflected light. This reflecting layer may comprise a preformed layer of a reflecting agent included in the film unit or the reflecting agent may be provided subsequent to photoexposure, e.g., by including the reflecting agent in the processing composition.

The aforementioned layers are preferably carried on a support and preferably are employed with another support positioned on the opposed surface of the layers carried by said first support so that the layers are sandwiched or confined between the support members, at least one of which is transparent to permit viewing of the final image. Such film units usually are employed in conjunction with means, such as, a rupturable container containing the requisite processing composition and adapted upon application of pressure of applying its contents to develop the exposed film unit. Film units of this type are now well known and are described, for example, in U.S. Pat. Nos. 3,415,644, 3,415,645, 3,415,646, 3,594,164 and 3,594,165.

The processing composition employed comprises an aqueous solution and usually, an aqueous alkaline solution of a silver halide developing agent and a silver halide solvent. The named ingredients may be present intially in the aqueous medium or may be present initially in the photographic film unit, for example, in the emulsion and/or image-receiving and/or spacer layers as heretofore suggested in the art. When such ingredients are present initially in the film unit, the processing composition is formed by contacting the product with a suitable aqueous medium to form a solution of these ingredients.

The alkali employed may be any of the alkaline materials heretofore employed, such as sodium or potassium hyroxide and like the developing agent and the solvent may be initially in a layer or layers of the film unit.

The silver halide solvent also may be any of the heretofore known materials, such as sodium or potassium thiosulfate, sodium thiocyanate or uracil; also the thioether-substituted uracils, pseudo-uracils and other compounds disclosed and claimed in U.S. Pat. No. 4,126,459; the 1,3-disulfonylalkanes and cycloalkanes of U.S. Pat. Nos. 3,769,014 and 3,958,992, respectively; or the alkanes containing an intralinear sulfonyl group and, e.g., an intralinear N-tosylsulfimido or N-tosylsulfoximido group as disclosed and claimed in U.S. Pat. No. 4,107,176. Also, a silver halide solvent precursor may be used such as those disclosed in U.S. Pat. No. 3,698,898 and as disclosed and claimed in copending U.S. Pat. application Ser. No. 382,479 filed May 27, 1982, now U.S. Pat. No. 4,382,119 issued May 3, 1983.

Examples of silver halide developing agents that may be employed are hydroquinone and substituted hydroquinones, such as tertiary butyl hydroquinone, 2,5-dimethyl hydroquinone, methoxyhydroquinone, ethoxyhydroquinone, 4'-methylphenylhydroquinone; pyrogallol and catechols, such as catechol, 4-phenyl catechol and tertiary butyl catechol; aminophenols, such as 2,4,6-diamino-orthocresol; 1,4-diaminobenzenes, such as p-phenylenediamine, 1,2,4-triaminobenzene and 4-amino-2-methyl-N,N-diethylaniline; ascorbic acid and its derivatives, such as ascorbic acid, isoascorbic acid and 5,6-isopropylidene ascorbic acid and other enediols, such as, tetramethyl reductic acid; hydroxylamines, such as N,N-di-(2-ethoxyethyl)hydroxylamine, N,N-di-(2-methoxyethyl)hydroxylamine and N,N-di-(2-methoxyethoxyethyl)hydroxylamine; and heterocyclic compounds, such as, 1-phenyl-3 pyrazolidone and 4-methyl-4-hydroxymethyl-1-phenyl-3-pyrazolidone.

Usually, though not necessarily, the processing composition includes a viscosity-increasing reagent such as a cellulosic polymer, e.g., sodium carboxymethyl cellulose, hydroxyethyl cellulose, carboxymethyl hydroxyethyl cellulose, etc; an oxime polymer, e.g., polydiacetone acrylamide oxime; or other high molecular weight polymers.

In addition to the aforementioned ingredients, the processing composition also may contain antifoggants, preservatives and other materials as conventionally used in the art.

The processing composition may be applied to the photosensitive element, for example, by coating, dipping, spraying or by the use of a rupturable container or pod such as disclosed in U.S. Pat. No. 2,543,181, the container being positioned in the film unit so as to be capable upon rupturing of spreading its contents in a substantially uniform layer.

The photosensitive element may be any of those conventionally employed in the formation of multicolor images and typically comprises a so-called tripack structure employing a blue-, a green- and a red-sensitive silver halide emulsion having associated therewith, respectively, a yellow, a magenta and a cyan image dye-providing material of the type described above wherein the photosensitive strata and their respective associated image dye-providing materials are processed simultaneously and without separation as a photosensitive laminate. The silver halide emulsion layers are carried on a base or support, for example, a plastic film, such as cellulose triacetate film, polyethylene terephthalate film, polystyrene film and polyolefin films, e.g., polyethylene and polypropylene films. The silver halide may be a silver chloride, iodide, bromide, iodobromide, chlorobromide, etc. The binder for the halide, though usually gelatin, may be a suitable polymer such as polyvinyl alcohol, polyvinyl pyrrolidone and their copolymers.

The image-receiving layer, i.e., dyeable stratum may comprise any of the materials known in the art, such as polyvinyl alcohol, gelatin, etc., preferably containing a mordant for the transferred image dye(s).

As is now well known, it is desirable to employ an acid-reacting reagent in a layer of the film unit to lower the environmental pH following substantial dye transfer in order to increase the image stability. For example, the previously mentioned U.S. Pat. No. 3,415,644 discloses systems wherein the desired pH reduction may be effected by providing an acid-reacting layer, e.g., a polymeric acid layer adjacent the dyeable stratum. The polymeric acids may be polymers which contain acid groups, e.g., carboxylic acid and sulfonic acid groups, which are capable of forming salts with alkali metals or with organic bases; or potentially acid-yielding groups such an anhydrides or lactones. Preferably the acid polymer contains free carboxyl groups. Alternatively, the acid-reacting reagent may be in a layer adjacent to the silver halide most distant from the image-receiving layer. Another system for providing an acid-reacting reagent is disclosed in U.S. Pat. No. 3,576,625.

An inert interlayer or spacer layer may be disposed between the polymeric acid layer and the dyeable stratum in order to control or "time" the pH reduction so that it is not premature and interferes with the development process. Suitable spacer or "timing" layers for this purpose are described with particularity in U.S. Pat. Nos. 3,362,819; 3,419,389; 3,421,893; 3,455,686; and 3,575,701.

The acid layer and associated spacer layer may be associated with the dyeable stratum, e.g., on the side of the dyeable stratum, e.g., on the side of the dyeable stratum opposed from the photosensitive element, or, if desired, they may be associated with the photosensitive strata, as is disclosed, for example, in U.S. Pat. Nos. 3,362,821 and 3,573,043. In film units such as those described in the aforementioned U.S. Pat. Nos. 3,594,164 and 3,594,165, they also may be contained on the spreader sheet employed to facilitate application of the processing composition.

In addition to the aforementioned layers, the film units may contain additional layers, such an antihalation layers, filter layers and silver ion barrier layers of the type disclosed in aforementioned U.S. Pat. No. 4,060,417.

For a fuller understanding of the photographic products and processes to which the present invention is directed, reference should be had to the accompanying drawing which illustrates one embodiment of the present invention.

As shown in the FIGURE, the photographic product (which has been selectively photoexposed) comprises a transparent support 2, carrying an image-receiving layer 4, a light-reflecting layer 6, a layer of cyan image dye-providing compound 8, a red-sensitive silver halide emulsion layer 20, an interlayer 12, a layer of magenta image dye-providing compound 14, a green-sensitive silver halide emulsion layer 16, an interlayer 18, a layer of yellow image dye-providing compound 20, a blue-sensitive silver halide emulsion 22, a protective top coat layer 24 and a spreader sheet 30 carrying an acid-reacting layer 32 containing a silver ion scavenger and a timing layer 34. An aqueous alkaline processing composition 26 is shown to be disposed between the top coat layer 24 protecting the outermost photosensitive silver halide emulsion layer and timing layer 34 carried on said spreader sheet. In exposed areas of emulsion layers 10, 16 and 22, silver halide is reduced to image silver while an imagewise distribution of soluble silver complex is formed in terms of unexposed areas. The imagewise distribution of soluble silver complex formed in each of the said emulsion layers is, at least in part, transferred by imbibition to the image dye-providing compound associated with each emulsion, i.e., the cyan, magenta and yellow image dye-providing compounds of layers, 8, 14 and 20, respectively. Each of said image dye-providing compounds undergoes a silver ion assisted cleavage reaction to liberate a diffusible cyan, magenta and yellow color-providing moiety, e.g., a cyan, a magenta and a yellow dye in areas corresponding to the unexposed areas of the respective emulsion layers 10, 16 and 22. The imagewise distributions of diffusible cyan, magenta and yellow dyes produced as a result of said silver ion cleavage reaction transfer, by diffusion, to the image-receiving layer 4. After formation of the transfer image in said image-receiving layer is substantially complete, the silver ion scavenger initially disposed in said acid-reacting layer 32 diffuses into the photosensitive layers and associated layers to capture substantially all of the silver ion and/or soluble silver ion and/or soluble silver complex present in the laminate. Depending upon the silver ion scavenger selected, the silver ion and/or soluble silver complex is reduced to metallic silver or converted to a stable silver complex. The multicolor image formed in said image-receiving layer 4 is viewed against said light-reflecting layer 6 through said transparent support 2 as a reflection print. It will be appreciated that the structural integrity of the laminate carrying the multicolor transfer image may be maintained in a known manner by providing, for example, a binding member extending around the edges of the laminate (not shown).

The following example is given to further illustrate the present invention and is not intended to limit the scope thereof.

A multicolor photosensitive laminate using as the image dye-providing compounds to provide a cyan dye, a magenta dye and a yellow dye cyan

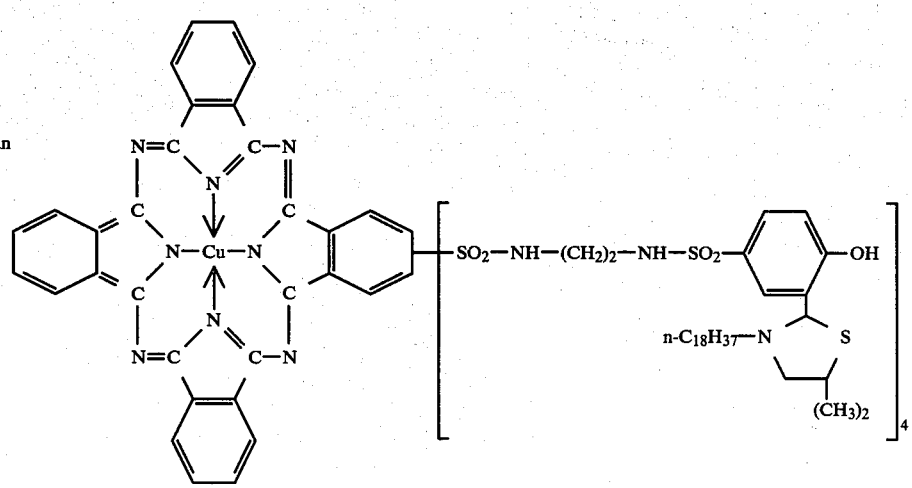

-continued magenta

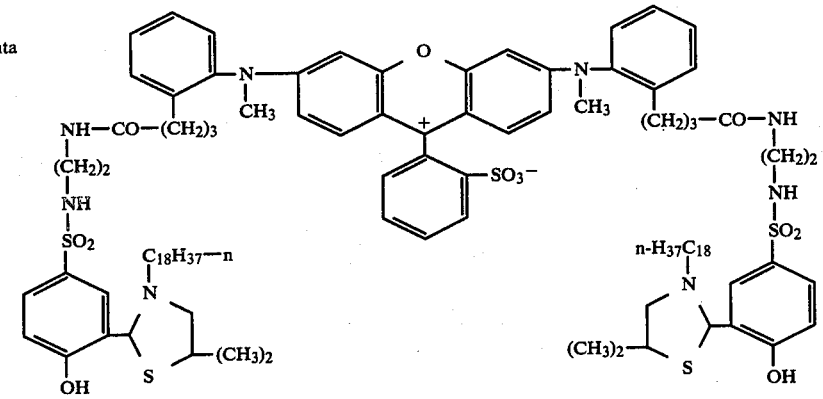

yellow

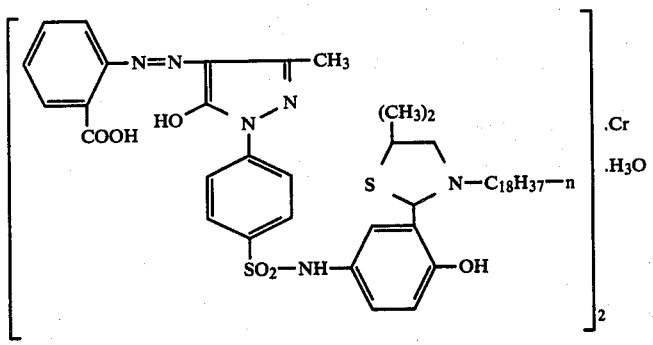

was prepared by coating a transparent polyethylene terephthalate film base with the following layers:

1. an image-receiving layer containing a 2:1 mixture of a graft copolymer comprising 4-vinyl pyridine (4 VP) and vinyl benzyl trimethyl ammonium chloride (TMQ) grafted onto hydroxyethyl cellulose (HEC) at a ratio HEC/4 VP/TMQ of 2.2/2.2/1 and gelatin;

2. a light-reflecting layer comprising titanium dioxide dispersed in a binder;

3. a layer of sodium cellulose sulfate coated at a coverage of about 34 mg/m$^2$ containing about 50 mg/m$^2$ of succindialdehyde;

4. a layer of cyan image dye-providing compound dispersed in gelatin and coated at a coverage of about 1290 mg/m$^2$ of cyan compound and about 877 mg/m$^2$ of gelatin;

5. a red-sensitive gelatino silver iodobromide emulsion coated at a coverage of about 258 mg/m$^2$ of silver and 228 mg/m$^2$ of gelatin and containing about 215 mg/m$^2$ of 4'-methylphenylhydroquinone;

6. an interlayer of a 60.6/29/6.3/3.7/0.4 pentapolymer of butylacrylate, diacetone acrylamide, methacrylic acid, styrene and acrylic acid coated at a coverage of 767 mg/m$^2$ and containing 40 mg/m$^2$ of polyacrylamide;

7. a layer of magenta image dye-providing compound dispersed in gelatin coated at a coverage of about 775 mg/m$^2$ of magenta compound and 538 mg/m$^2$ gelatin and containing about 65 mg/m$^2$ of Monastral Red B filter dye and about 538 mg/m$^2$ 6-n-butylthiomethyl-2,4-dihydroxypyrimidine as a silver halide solvent;

8. a green-sensitive gelatino silver iodobromide emulsion coated at a coverage of 129 mg/m$^2$ of silver and 228 mg/m$^2$ of gelatin and containing about 215 mg/m$^2$ of 4'-methylphenylhydroquinone;

9. an interlayer the same as layer 6;

10. a layer of yellow image dye-providing compound dispersed in gelatin and coated at a coverage of about 1076 mg/m$^2$ of yellow compound and 538 mg/m$^2$ of gelatin and containing about 807 mg/m$^2$ of a yellow filter dye;

11. an unsensitized gelatino silver iodobromide emulsion coated at a coverage of 161 mg/m$^2$ of silver and 181 mg/m$^2$ of gelatin and containing 332 mg/m$^2$ of 4'-methylhydroquinone;

12. a protective top coat layer of gelatin coated at a coverage of 323 mg/m$^2$.

A spreader sheet was prepared by coating a transparent polyethylene terephthalate film base with the following layers.

(1) a polymeric acid layer containing a mixture of about 9 parts of a partial butyl ester of polyethylene/-maleic anhydride copolymer and 1 part of plyvinyl butyral coated at a coverage of about 2500 mg/ft$^2$ (about 26,900 mg/m$^2$) and (2) a timing layer containing a b 14:1 ratio of a 60.6/29/6.3/3.7/0.4 pentapolymer of butylacrylate, diacetone acrylamide, styrene, methacrylic acid and acrylic acid and polyvinyl alcohol coated at a coverage of about 500 mg/ft$^2$ (about 5380 mg/m$^2$).

In addition to the above spreader sheet prepared as a control, two spreader sheets A and B containing a silver ion scavenger in layer (1) were prepared in the same manner using the developing agent of the following formula as said scavenger. (The photographic use of this developing agent forms the subject matter of aforementioned U.S. patent application Ser. No. 221,291.)

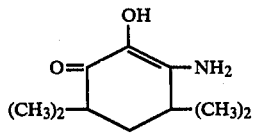

Spreader sheet A differed from the control in that layer (1) contained 100 mgs of the above-denoted developing agent dispersed therein and layer (2) was coated at a coverage of 300 mg/ft$^2$ (about 3230 mg/m$^2$).

Spreader sheet B differed from the control in that layer (1) also contained 100 mgs of the above-denoted developing agent and layer (2) was coated at a coverage of 600 1 mg/ft$^2$ (about 6460 mg/m$^2$).

Three photosensitive laminates as prepared above were given a standard sensitometric exposure and then assembled with the respective spreader sheets to provide a control film unit, film unit A and film unit B. A rupturable container retaining an aqueous alkaline processing composition was mounted between each photosensitive laminate and its spreader sheet such that upon application of compressive pressure to rupture the container, its contents are distributed in a layer between the top coat layer 12 of the photosensitive laminate and layer (2) of the spreader sheet.

The aqueous alkaline processing composition comprised the following:

| | |
|---|---|
| Water | 100 g. |
| Titanium dioxide | 50 g. |
| 6-methylthiomethyl-2,4-dihydroxypyrimidines | 1.5 g. |
| 2-thiouracil | 0.009 g. |
| Sodium hydroxide | 5.0 g. |
| Carboxymethyl hydroxyethyl cellulose | 0.2 g. |

Each of the exposed film units was passed between a pair of pressure rolls (in the dark) so that a layer approximately 0.0044 inch thick of processing composition was distributed between said layers 24 and (2). The film units were maintained intact to provide a unitary structure, and after about 10 minutes in the dark at room temperature, the maximum and minimum red, green and blue reflection densitites were measured for the transfer image through the transparent support against the light-reflecting layer 2. The minimum reflection densities also were measured after one day, after two days and after about seven months. The results are summarized in the following Table.

TABLE

| Sample | Dmax (10 min) | Dmin (10 min) | Dmin (1d.) | Dmin (2d.) | Dmin (7 mos) |
|---|---|---|---|---|---|
| Control | | | | | |
| R | 1.89 | 0.36 | 0.34 | 0.33 | 0.37 |
| G | 2.22 | 0.33 | 0.46 | 0.64 | 0.75 |
| B | 2.31 | 0.40 | 0.41 | 0.46 | 0.54 |
| Film Unit A | | | | | |
| R | 1.42 | 0.30 | 0.29 | 0.30 | 0.32 |
| G | 2.06 | 0.28 | 0.30 | 0.40 | 0.47 |
| B | 2.24 | 0.34 | 0.36 | 0.43 | 0.49 |
| Film Unit B | | | | | |
| R | 1.67 | 0.31 | 0.33 | 0.34 | 0.35 |
| G | 2.43 | 0.33 | 0.36 | 0.40 | 0.46 |
| B | 2.41 | 0.40 | 0.44 | 0.44 | 0.50 |

As can be seen from reference to the above Table, the build-up in green minimum density over time for film units A and B employing a silver ion scavenger was substantially less than the control which resulted in improved color separation.

In a further comparison using ascorbic acid palmitate as the silver ion scavenger, similar results were obtained showing improved color isolation in the green column and improved color separation.

Since certain changes may be made in the above products and processes without departing from the scope of the invention herein involved, it is intended that all matter contained in the above description or shown in the accompanying drawing shall be interpreted as illustrative and not in a limiting sense.

What is claimed is:

1. In a photographic product for providing a multicolor image comprising a plurality of layers which are maintained intact subsequent to image formation including a support, at least two selectively sensitive silver halide emulsion layers on said support, each of said emulsion layers having associated therewith an image dye-providing compound capable of undergoing silver ion assisted cleavage in the presence of an imagewise distribution of silver ions and/or soluble silver complex to provide a color-providing moiety in an imagewise distribution corresponding to said distribution of silver ions and/or soluble silver complex to form a dye image:

the improvement which comprises including a silver halide developing agent in one of the afore said layers or in a separate layer, said developing agent being so positioned and/or so constituted that it is made available to reduce said silver ions and/or soluble silver complex at a predetermined time after but not prior to substantially complete formation of said dye image.

2. A photographic product as defined in claim 1 which includes an acid-reacting layer.

3. A photographic product as defined in claim 2 wherein said selectively sensitive emulsion layers are a red-sensitive emulsion, a green-sensitive emulsion and a blue-sensitive emulsion, and said image dye-providing compounds associated with said silver halide emulsions are, respectively, a cyan image dye-providing compound, a magenta image dye-providing compound and a yellow image dye-providing compound.

4. A photographic product as defined in claim 3 wherein each said image dye-providing compounds is substantially non-diffusible and undergoes cleavage to release a diffusible color-providing moiety.

5. A photographic product as defined in claim 4 wherein said diffusible color-providing moiety is a diffusible dye and said photographic product includes a superposed image-receiving layer so positioned as to be capable of receiving by diffusion transfer an imagewise distribution of each said diffusible dye.

6. A photographic product as defined in claim 5 wherein said product includes means for providing a light-reflecting layer between said image-receiving layer and said silver halide emulsion layer to mask said emulsion layers after development thereof and to provide a white background for viewing a dye image in said image-receiving layer.

7. A photographic product as defined in claim 6 which includes a second support and additionally includes means for applying an aqueous alkaline processing composition.

8. A photographic product as defined in claim 7 wherein said silver halide emulsion layers and their associated image dye-providing compounds are carried on said support, said image-receiving layer is carried on said second support and said means for applying an aqueous alkaline processing composition is positioned to provide a substantially uniform layer of processing composition between the outermost layer carried on said support and the outermost layer carried on said second support.

9. A photographic product as defined in claim 8 wherein said means for providing a light-reflecting layer comprises a white pigment dispersed in said processing composition.

10. A photographic product as defined in claim 7 wherein said image-receiving layer is carried on said support and said silver halide emulsion layers and their associated image dye-providing compounds are disposed over said image-receiving layer, said acid-reacting layer is carried on said second support and said means for applying an aqueous alkaline processing composition is positioned to provide a substantially uniform layer of processing composition between the outermost layer carried on said support and the outermost layer carried on said second support.

11. A photographic product as defined in claim 10 wherein said means for providing a light-reflecting layer comprises a preformed layer of white pigment positioned between said image-receiving layer and the next adjacent of said silver halide emulsion layers with its associated image dye-providing compound.

12. A photographic product as defined in claim 11 which includes a timing layer coated over said acid-reacting layer.

13. A photographic product as defined in claim 2 wherein said silver halide developing agent is contained in said acid-reacting layer.

14. A photographic product as defined in claim 12 wherein said silver halide developing agent is contained in said acid-reacting layer.

15. In a photographic process for producing a multicolor image including the steps of exposing a film unit comprising a plurality of layers including a support at least two selectively sensitive silver halide emulsion layers on said support, each of said emulsion layers having associated therewith an image dye-providing compound capable of undergoing silver ion assisted cleavage in the presence of an imagewise distribution of silver ions and/or soluble silver complex to provide a color-providing moiety in an imagewise distribution corresponding to said distribution of silver ions and/or soluble silver complex; applying an aqueous alkaline processing composition to said film unit to provide an aqueous alkaline solution of a silver halide developing agent and a silver halide solvent thereby developing said silver halide emulsion layers; forming in undeveloped areas of each of said emulsions layers an imagewise distribution of silver ions and/or soluble silver complex; contacting said imagewise distribution of silver ions and/or soluble silver complex formed in each of said emulsion layers with said emulsion layers associated image dye-providing compound thereby forming corresponding imagewise distributions of each of said color-providing moieties to form a dye image; and maintaining said layers intact subsequent to processing:

the improvement which comprises providing a silver halide developing agent to reduce said silver ions and/or soluble silver complex at a predetermined time after but not prior to substantially complete formation of said dye image, said silver halide developing agent being included in one of the aforesaid layers or in a separate layer and being so positioned and/or so constituted that it is made available at said predetermined time.

16. A photographic process as defined in claim 15 wherein said film unit includes an acid-reacting layer.

17. A photographic process as defined in claim 16 wherein said selectively sensitized emulsion layers are a red-sensitive emulsion, a green-sensitive emulsion and a blue-sensitive emulsion, and said image dye-providing compounds associated with said silver halide emulsions are, respectively, a cyan image dye-providing compound, a magenta image dye-providing compound and a yellow image dye-providing compound.

18. A photographic process as defined in claim 17 wherein each said image dye-providing compounds is substantially non-diffusible and undergoes cleavage to release a diffusible color-providing moiety.

19. A photographic process as defined in claim 18 wherein said diffusible color-providing moiety is a diffusible dye and said photographic film unit includes a superposed image-receiving layer so positioned as to be capable of receiving by diffusion transfer an imagewise distribution of each said diffusible dye.

20. A photographic process as defined in claim 19 wherein said film unit includes means for providing a light-reflecting layer between said image-receiving layer and said silver halide emulsion layers to mask said emulsion layers after development thereof and to provide a white background for viewing a dye image in said image-receiving layer.

21. A photographic process as defined in claim 20 wherein said film unit includes a second support and additionally includes means for applying an aqueous alkaline processing composition.

22. A photographic process as defined in claim 21 wherein said silver halide emulsion layers and their associated image dye-providing compounds are carried on said support, said image-receiving layer is carried on said second support and said means for applying an aqueous alkaline processing composition is positioned to provide a substantially uniform layer of processing composition between the outermost layer carried on said support and the outermos,t layer carried on said second support.

23. A photographic process as defined in claim 22 wherein said means for providing a light-reflecting layer comprises a white pigment dispersed in said processing composition.

24. A photographic process as defined in claim 21 wherein said image-receiving layer is carried on said support and said silver halide emulsion layers and their associated image dye-providing compounds are disposed over said image-receiving layer, said acid-reacting layer is carried on said second support and said means for applying an aqueous alkaline processing composition is positioned to provide a substantially uniform layer of processing composition between the outermost layer carried on said support and the outermost layer carried on said second support.

25. A photographic process as defined in claim 24 wherein said means for providing a light-reflecting layer comprises a preformed layer of white pigment positioned between said image-receiving layer and the next adjacent of said silver halide emulsion layers with its associated image dye-providing compound.

26. A photographic process as defined in claim 25 wherein said film unit includes a timing layer coated over said acid-reacting layer.

27. A photographic process as defined in claim 15 which includes the step of reducing the pH subsequent to image formation.

28. A photographic process as defined in claim 15 wherein said capturing of said silver ions and/or soluble silver complex is effected at a pH below the pH at which said imagewise distributions of each said color-providing moieties are formed.

29. A photographic process as defined in claim 16 wherein said silver halide developing agent is contained in said acid-reacting layer.

30. A photographic process as defined in claim 26 wherein said silver halide developing agent is contained in said acid-reacting layer.

* * * * *